US011286106B1

(12) United States Patent
Meeks

(10) Patent No.: US 11,286,106 B1
(45) Date of Patent: Mar. 29, 2022

(54) CRATE ASSEMBLY

(71) Applicants: Robert B. Jordan, IV, Mt. Gilead, NC (US); Eddie Alexander Meeks, Greensboro, NC (US)

(72) Inventor: Eddie Alexander Meeks, Greensboro, NC (US)

(73) Assignees: Robert B. Jordan, IV, Mt. Gilead, NC (US); Eddie Alexander Meeks, Greensboro, NC (US)

( * ) Notice: Subject to any disclaimer, the term of this patent is extended or adjusted under 35 U.S.C. 154(b) by 368 days.

(21) Appl. No.: 16/655,637

(22) Filed: Oct. 17, 2019

Related U.S. Application Data

(60) Provisional application No. 62/752,402, filed on Oct. 30, 2018.

(51) Int. Cl.
*B65D 90/02* (2019.01)
*B65D 90/08* (2006.01)
*B65D 88/12* (2006.01)

(52) U.S. Cl.
CPC ..... *B65D 90/026* (2013.01); *B65D 88/12* (2013.01); *B65D 90/08* (2013.01)

(58) Field of Classification Search
CPC .. B65D 9/12; B65D 11/1873; B65D 11/1866; B65D 90/026; B65D 88/12; B65D 90/08
See application file for complete search history.

(56) References Cited

U.S. PATENT DOCUMENTS

| | | | | |
|---|---|---|---|---|
| 419,920 A * | 1/1890 | Campbell | B65D 9/12 217/43 R |
| 1,088,565 A * | 2/1914 | Greene | B65D 9/12 217/43 R |
| 1,214,815 A * | 2/1917 | Morris | B65D 9/12 217/43 R |
| 5,509,574 A * | 4/1996 | Lenz et al. | H05K 13/0084 206/499 |
| 5,638,973 A | 6/1997 | Dewey | 220/4.33 |
| 5,722,551 A | 3/1998 | Cocciemiglio, Jr. | 220/4.33 |

FOREIGN PATENT DOCUMENTS

| | | | |
|---|---|---|---|
| ES | 2301405 | 6/2008 | B65D 6/26 |
| FR | 2956384 | 2/2010 | B65D 19/38 |

* cited by examiner

*Primary Examiner* — Stephen J Castellano
(74) *Attorney, Agent, or Firm* — MacCord Mason PLLC

(57) ABSTRACT

A crate assembly for storing one or more items. The crate has a bottom face and a plurality of side faces, wherein the bottom face comprises a plurality of slat assemblies installed onto the bottom rail assemblies and each side face comprises a plurality of slat assemblies installed onto a pair of corner rail assemblies. In one embodiment, the crate includes a plurality of slats with each slat having a cap on each end making a slat assembly with the cap having a channel adapted to slide the slat along a rail, a plurality of corner rail assemblies each defining a corner of the crate assembly with each corner rail assembly including a vertical rail adapted for receiving the cap of a slat assembly; and a plurality of bottom rail assemblies. Each bottom rail assembly has one end connected to a bottom end of one corner rail assembly and an opposing end connected to a bottom end of another corner rail assembly. Each bottom rail assembly also includes a horizontal rail adapted for receiving the cap of a slat assembly.

18 Claims, 10 Drawing Sheets

CRATE ASSEMBLY

This application claims domestic benefit to U.S. Provisional Application No. 62/752,402 filed 30 Oct. 2018.

BACKGROUND OF THE INVENTION

The present invention relates to a crate assembly, a kit for a crate, and a method for assembling. Crates are containers having a self-supporting structure that enables the transport of items within. Preferably, a crate's design is based on a material and configuration that is lightweight while still having sufficient strength to carry the weight of the items without falling apart. Crates are thus typically comprised of wood for this reason. Yet, current crates require various tools for assembly and are limited in the materials that can be used due to the above considerations.

Applicant wishes to provide an improved crate assembly that is durable and can be easily customized during manufacturing, while at the same time, remaining easy to assemble without requiring tools.

SUMMARY OF THE INVENTION

The present invention fulfills one or more of these needs in the art by providing a crate assembly having a bottom face and a plurality of side faces formed from a plurality of slats, corner rail assemblies and bottom rail assemblies. Each slat has a cap on each end to form a slat assembly, and the cap includes a channel adapted to slide the slat along a rail. Each corner rail assembly includes a vertical rail adapted for receiving the cap of a slat assembly and defines a corner of the crate assembly. Each bottom rail assembly has one end connected to a bottom end of one corner rail assembly and an opposing end connected to a bottom end of another corner rail assembly, and includes a horizontal rail adapted for receiving the cap of a slat assembly. The bottom face comprises slat assemblies installed onto the bottom rail assemblies and each side face comprises slat assemblies installed onto a pair of corner rail assemblies. In one embodiment, two bottom rail assemblies are attached to four corner rail assemblies to form a crate assembly having a substantially cuboidal shape.

Each bottom rail assembly may include a second rail and each corner rail assembly includes a slot for receiving the second rail of the bottom rail assembly. For example, the second rail and the slot may be substantially T-shaped. In one embodiment, the slot and the second rail comprise a T-shape having about a 45 degree angle crevice on each side of the T-shape to prevent the slot from splaying and releasing the second rail when a load is applied.

A lock may be included on each corner rail assembly to secure the bottom rail assembly onto the corner rail assembly. One example of a suitable lock comprises a hook on the corner rail assembly, a recess adapted to receive the hook on the bottom rail assembly, and a ridge on the bottom rail assembly adapted to retain the hook within the recess.

A top cap may be installed on each corner rail assembly to secure the slats. In one embodiment, the top cap is secured by inserting a hook on the top cap over a ridge onto a recess on a top end of the corner rail assembly whereby the ridge retains the hook within the recess.

Each corner rail assembly may be comprised of two walls with a vertical rail on each wall. Each slat may be comprised of wood.

In one embodiment, the channel and the rail each have one of a substantially round male/female complement to prevent the slat from detaching from the rail. For example, the female complement may be on the channel and the male complement may be on the rail.

Another aspect of the present invention is directed to a crate assembly comprising a plurality of slats with each slat having a cap on each end making a slat assembly, a set of four corner rail assemblies each defining a corner of the crate assembly, a set of two bottom rail assemblies whereby each bottom rail assembly has one end connected to a bottom end of one corner rail assembly and an opposing end connected to a bottom end of another corner rail assembly, and a set of locks for securing each bottom rail assembly to a corner rail assembly. The caps each include a channel adapted to slide the slat along a rail. Each corner rail assembly includes a vertical rail adapted for receiving the cap of a slat assembly and a substantially T-shaped slot. Each bottom rail assembly includes a horizontal rail adapted for receiving the cap of a slat assembly and a substantially T-shaped rail for insertion into the substantially T-shaped slot of the corner rail assembly. Each lock comprises a hook on the corner rail assembly, a recess adapted to receive the hook on the bottom rail assembly, and a ridge on the bottom rail assembly adapted to retain the hook within the recess. The assembled crate assembly has a bottom face and a plurality of side faces, the bottom face comprising slat assemblies installed onto the bottom rail assemblies and each side face comprising slat assemblies installed onto a pair of corner rail assemblies.

Still another aspect of the present invention is directed to a kit for assembling a crate. One embodiment of the kit comprises a plurality of slats, a plurality of caps each adapted to be fitted onto an end of a slat to make a slat assembly with each cap having a channel adapted to slide the slat assembly along a rail, a plurality of corner rail assemblies each defining a corner of the crate whereby each corner rail assembly includes a vertical rail adapted for receiving the cap of a slat assembly; and a plurality of bottom rail assemblies where each bottom rail assembly has one end connected to a bottom end of one corner rail assembly and an opposing end connected to a bottom end of another corner rail assembly. Each bottom rail assembly includes a horizontal rail adapted for receiving the cap of a slat assembly. A bottom face of the crate is formed by installing slat assemblies onto the bottom rail assemblies and a side face of the crate is formed by installing slat assemblies onto a pair of corner rail assemblies. The kit may also include a plurality of top caps adapted to be mounted onto a top end of each corner rail assembly to secure the slats onto the vertical rails.

The present invention can also be considered a method for assembling a crate. In one example, the method may comprise placing a cap having a channel on each end of a slat for a plurality of slats to make a plurality of slat assemblies. A first bottom rail assembly having a horizontal rail is connected to a pair of corner rail assemblies each having a vertical rail, and a second bottom rail assembly having a horizontal rail is connected to another pair of corner rail assemblies each having a vertical rail. One or more slat assemblies are slid along the horizontal rails of the first and second bottom rail assemblies to form a bottom face, and one or more slat assemblies are slid along the vertical rails for each pair of corner rail assemblies to form a set of side faces. The method may further include the step of connecting a top cap onto a top end of each corner rail assembly to secure the slat assemblies onto the vertical rails.

BRIEF DESCRIPTION OF THE DRAWINGS

The invention will be better understood by a reading of the Detailed Description of the Examples of the Invention along with a review of the drawings, in which.

DETAILED DESCRIPTION OF EXAMPLES OF THE INVENTION

Figure 1:
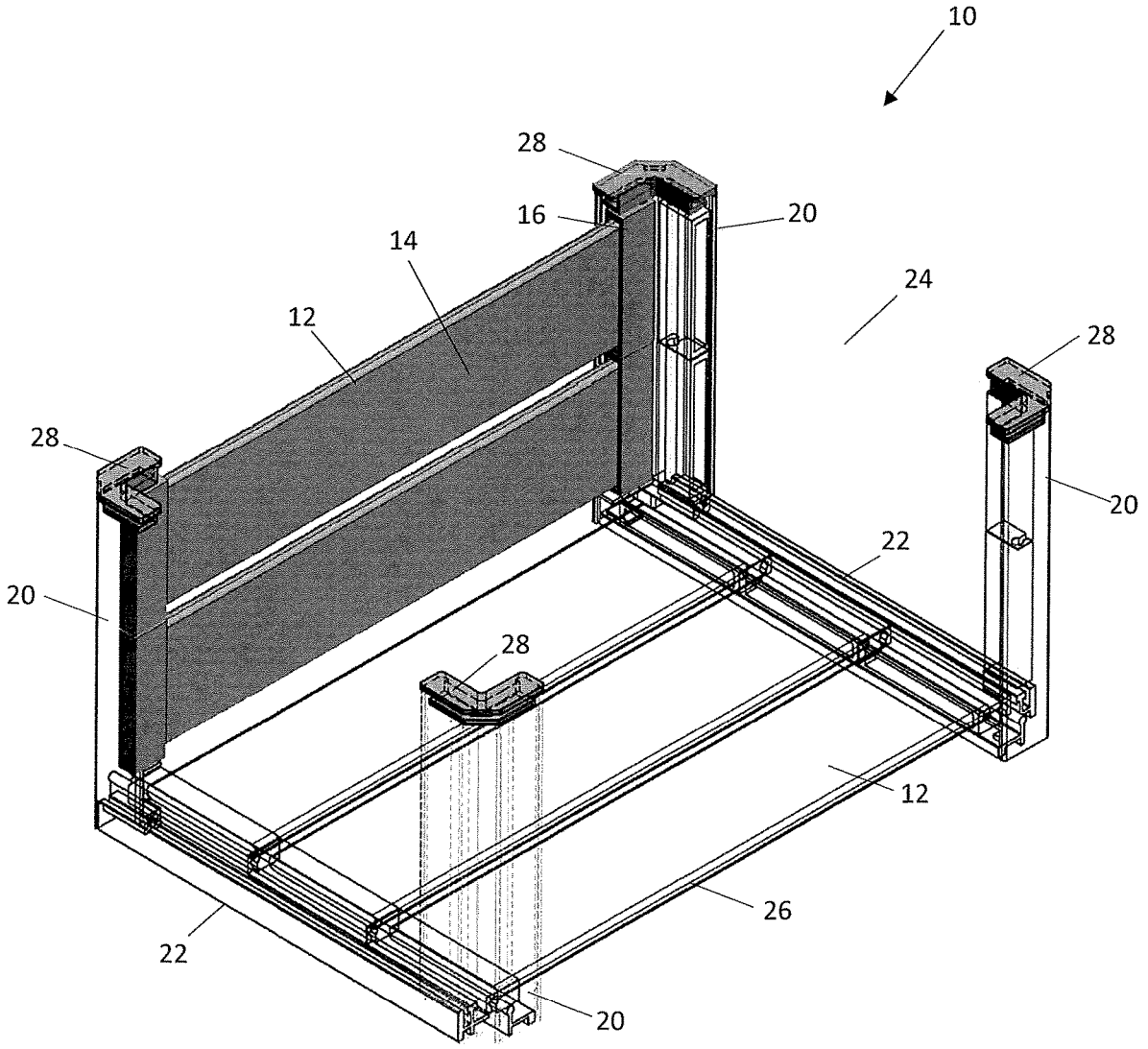
FIG. 1 is an overhead perspective view of a crate assembly constructed according to one embodiment.

FIG. 1 shows one embodiment of a crate assembly 10 comprised of a plurality of slat assemblies 12 connected to a plurality of corner rail assemblies 20 to form the side faces 24 and a plurality of slat assemblies 12 connected to a plurality of bottom rail assemblies 22 to form a bottom face 26. The cap 16, corner rail assemblies 20, and bottom rail assemblies 22 may be formed of a polymer such as thermoplastic and may be produced via injection molding or other similar processes.

Figure 2:
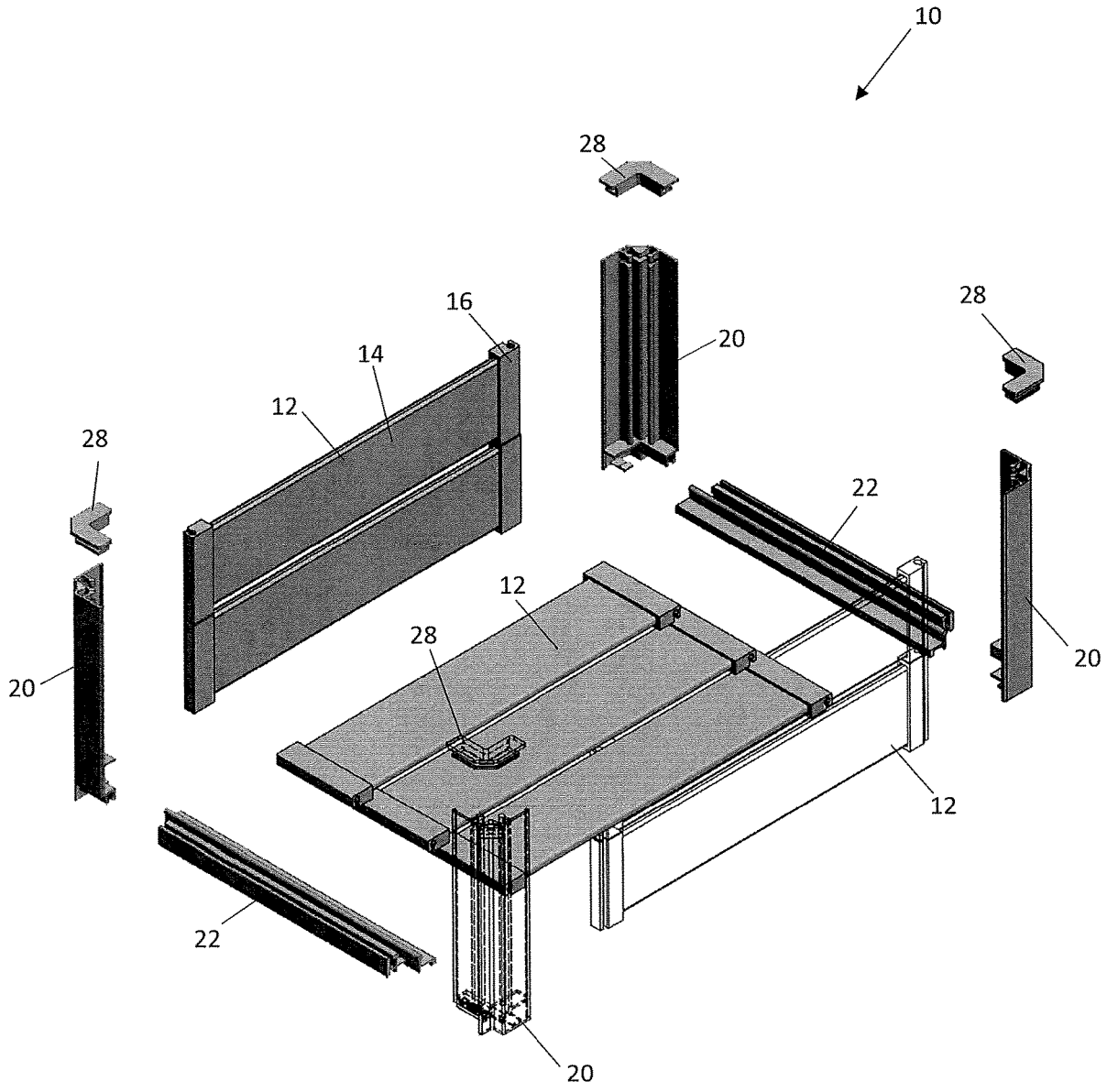
FIG. 2 is an exploded view of the crate assembly shown in FIG. 1.

Each slat assembly 12 is comprised of a slat 14 having a cap 16 installed on each end. The slat may be comprised of cellulosic, polymeric or metallic materials. For example, the slat may be comprised of wood or a wood-plastic composite. The caps 16 enable the slat assembly 12 to be installed on either a corner rail assembly 20 or a bottom rail assembly 22. As seen in FIG. 2, each slat assembly may be installed onto either a pair of corner rail assemblies 20 or a pair of bottom rail assemblies 22, wherein each cap of the bottom rail assembly is installed onto a rail assembly. A top cap 28 may be installed onto each corner rail assembly 20 to secure the slat assemblies 12 and prevent them from sliding off the rails when the crate assembly 10 is inverted.

Figure 3:
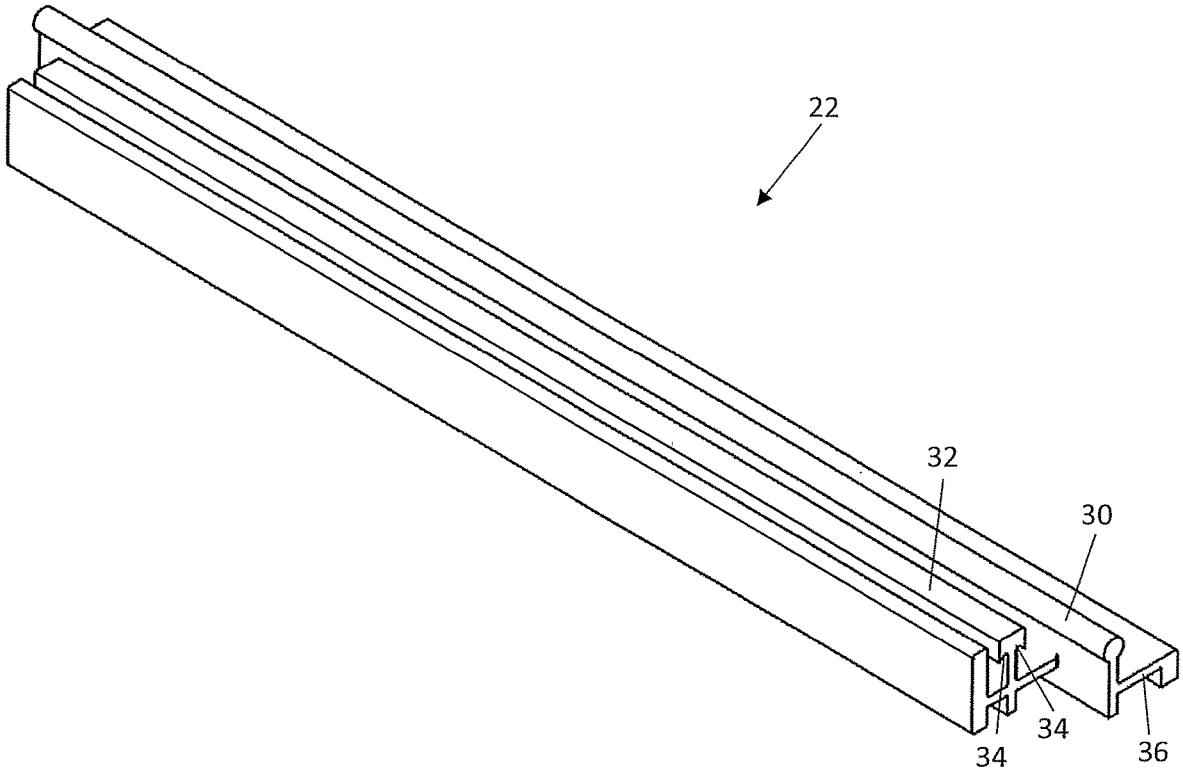
FIG. 3 is an overhead perspective view of a bottom rail assembly according to one embodiment.
Figure 4:
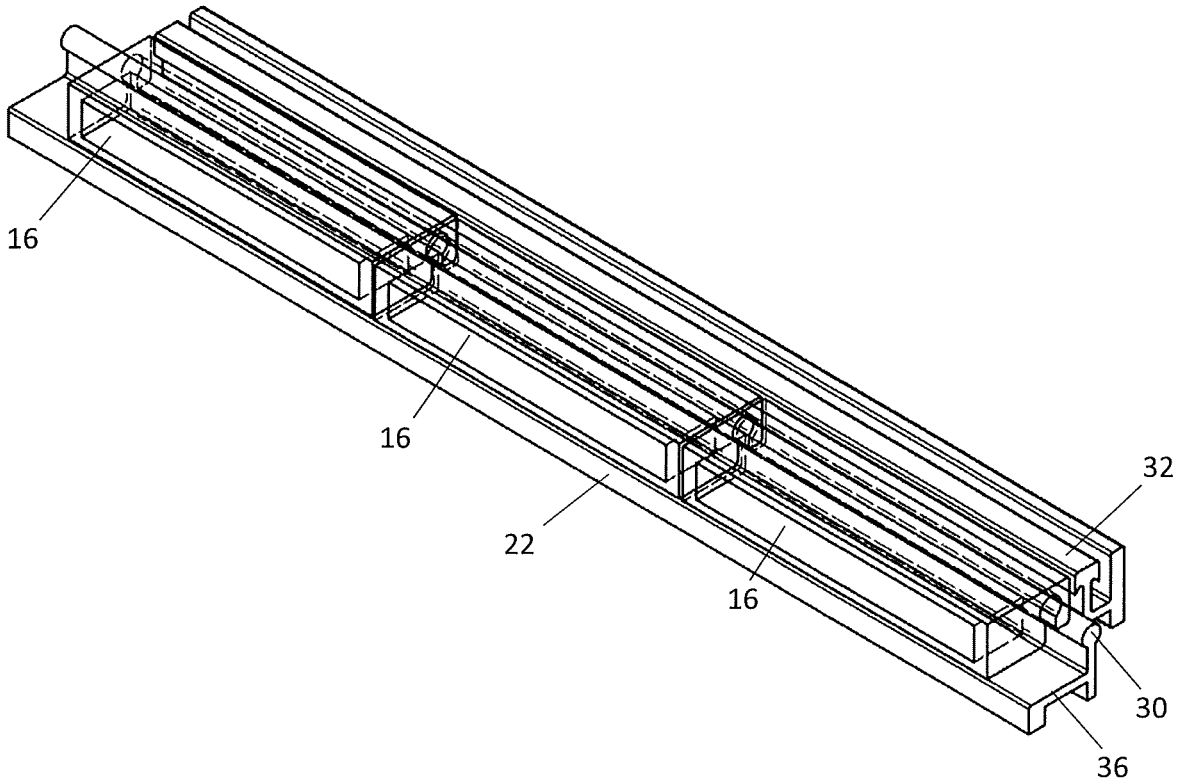
FIG. 4 is a schematic view of the bottom rail assembly shown in FIG. 3 with several caps installed on the horizontal rail.
Figure 5:
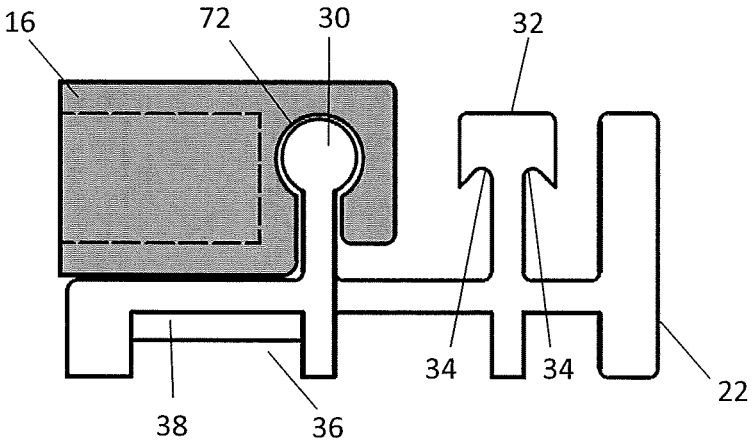
FIG. 5 is an end view of the bottom rail assembly and caps shown in FIG. 4.

One embodiment of a bottom rail assembly 22 is shown in FIG. 3. The bottom rail assembly 22 includes a horizontal rail 30 adapted for receiving a plurality of caps 16, as seen in FIGS. 4 and 5. The horizontal rail 30 and a channel 72 of the cap may be round to prevent the slat assemblies 12 from unintentionally detaching from the rail by a directional force away from the rail. Other shapes can be used. The bottom rail assembly also includes a second rail 32 for connecting to a corner rail assembly 20. The second rail 32 may be substantially T-shaped, and may further include a 45° angle crevice 34 on each side. The crevice 34 prevents the corner rail assembly 20 from splaying when a load is placed on it from the weight of objects stored in the crate assembly 10. The bottom rail assembly may also include a recess 36 with a ridge 38 near each end of rail 30 (see FIG. 5) adapted for receiving and retaining a hook 50 of a corner rail assembly 20.

Figure 6:
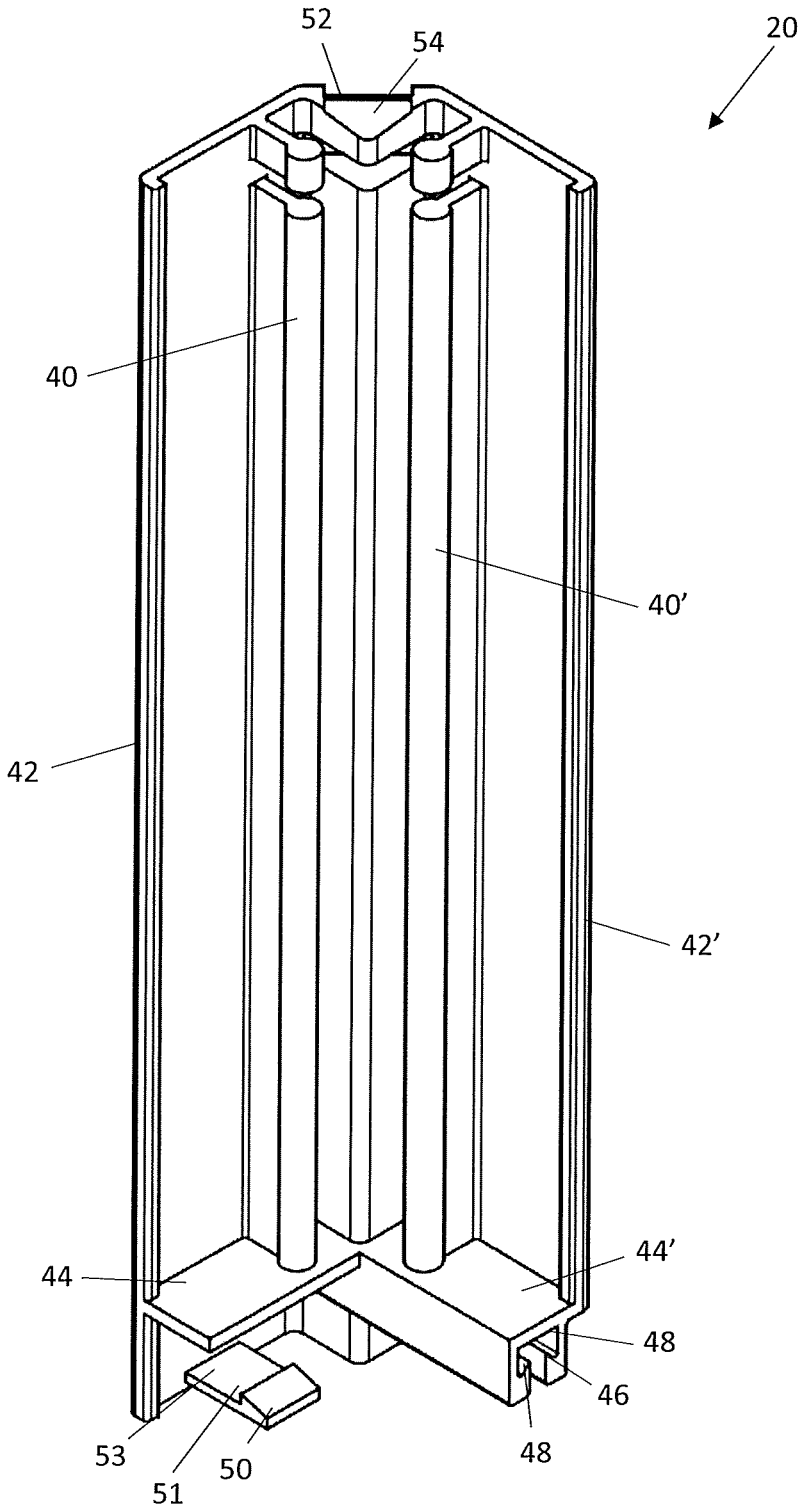
FIG. 6 is a front perspective view of a corner rail assembly according to one embodiment.

FIG. 6 depicts one embodiment of a corner rail assembly 20. The corner rail assembly 20 includes a vertical rail 40 installed on a wall 42 for receiving a plurality of caps 16. The wall 42 further includes a floor 44 to support the slat assemblies 12 at one end of the corner rail assembly 20. In the embodiment shown, the corner rail assembly 20 is comprised of a first wall 42 and a second wall 42', with the second wall 40' having a vertical rail 40' and a floor 44'. The angle between first wall 42 and second wall 42' may vary in different embodiments depending on the overall shape of the crate assembly 10. As seen by the embodiment shown in FIG. 6, the angle defined by the first wall 42 and the second wall 42' is about 90 degrees for forming a crate assembly having a substantially cuboidal shape.

The corner rail assembly 20 also includes a slot 46 for receiving a second rail 32 of a bottom rail assembly 22. In the embodiment shown, the slot 46 is substantially T-shaped and further includes a pair of 45 degree angle crevices 48 on each side to prevent the slot 46 from splaying and releasing the bottom rail assembly 22 when objects are placed within the crate assembly 10. A hook 50 may also be provided for attaching the corner rail assembly 20 to the ridge 38 of a bottom rail assembly 22. The hook 50 may be placed within a recess 36 found on a bottom rail assembly 22 and spring-latched onto ridge 38 (as seen in FIG. 5). The edge 51 lodges onto the inner edge of ridge 38, held in place by the resilience of the stem 53. The hook 50 prevents the corner rail assembly 20 and the bottom rail assembly 22 from detaching in a horizontal direction while the slot 46 and second rail 32 prevents the corner rail assembly 20 and the bottom rail assembly 22 from detaching in a vertical direction.

Figure 7:
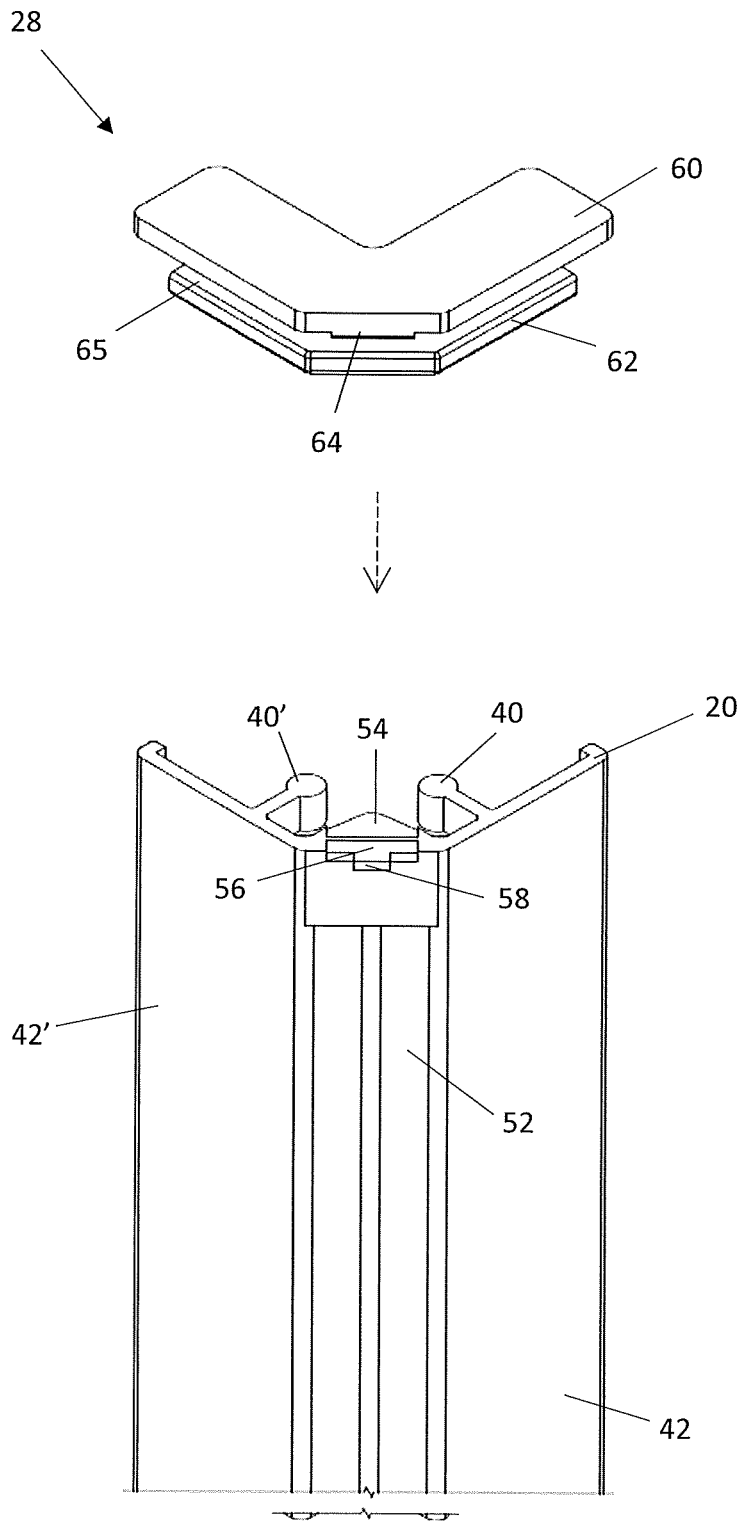
FIG. 7 is an exploded view of the back of a corner rail assembly with a top cap according to one embodiment.
Figure 8:
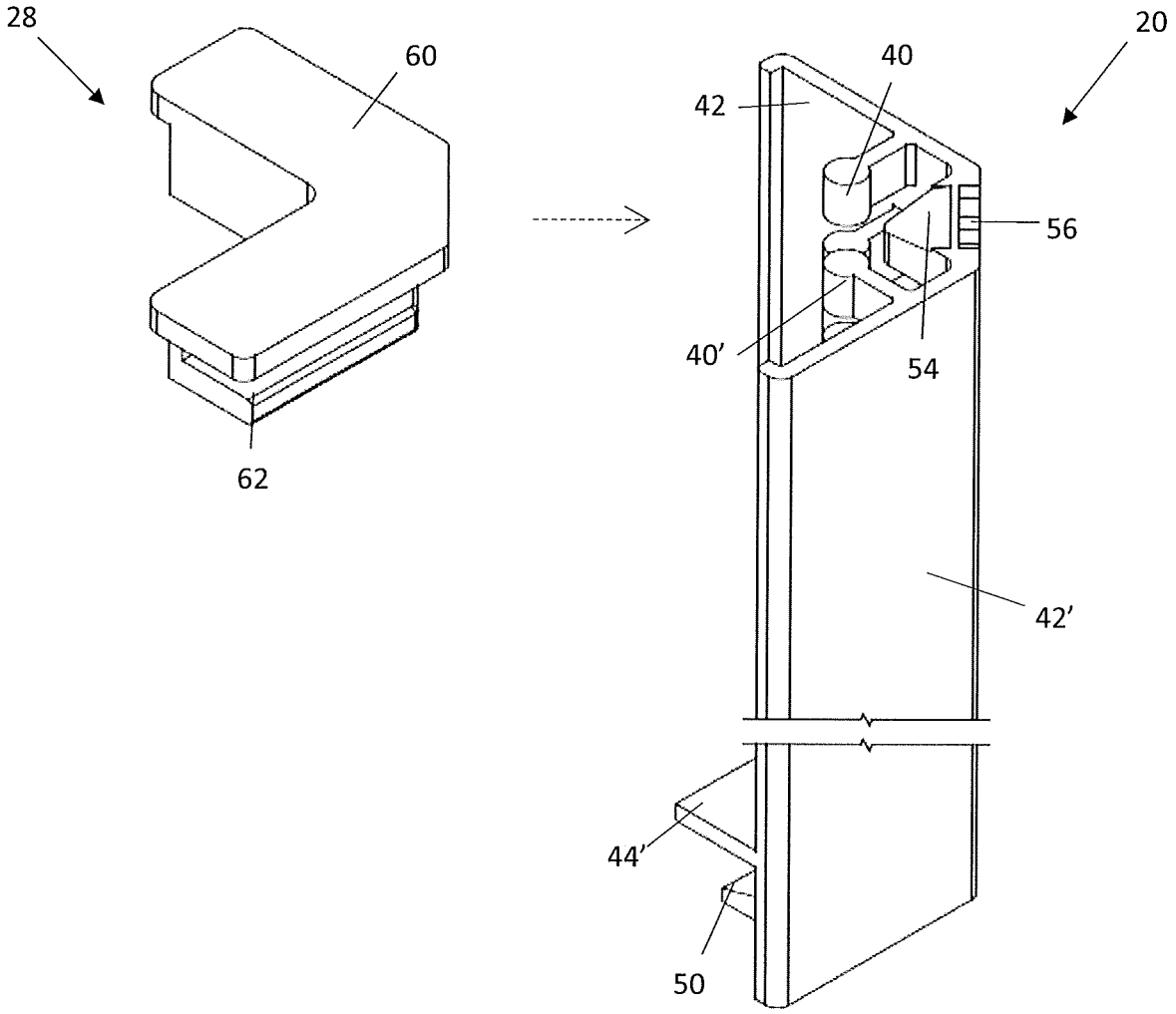
FIG. 8 is an exploded view of the side of the corner rail assembly and top cap shown in FIG. 7.
Figure 9:
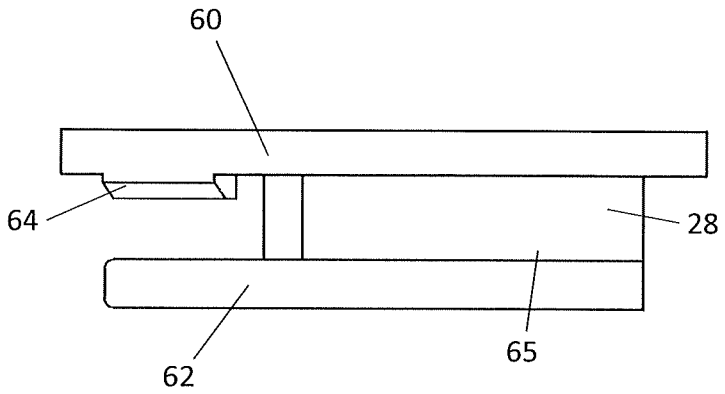
FIG. 9 is a side view of the top cap shown in FIG. 7.

The top end of the corner rail assembly 20 may be secured by a top cap 28 as shown in FIGS. 7-9. The top cap 28 is comprised of a top end 60 having a hook 64 and a bottom end 62. The top end 60 and the bottom end 62 are separated by a channel 65 adapted to fit over a portion of the vertical rails 40 and 40'. The corner rail assembly 20 may include a corner wall 52 with a ridge 54, so a hook 64 from top cap 28 can slide past ridge 54 to lodge in a recess 56. A slot 58 (see FIG. 14) may also be included to facilitate removal of the top cap 28 once it is secured to the corner rail assembly 20; for example, by using a flathead screwdriver to lift the hook 64 away from the recess 56.

Figure 10:
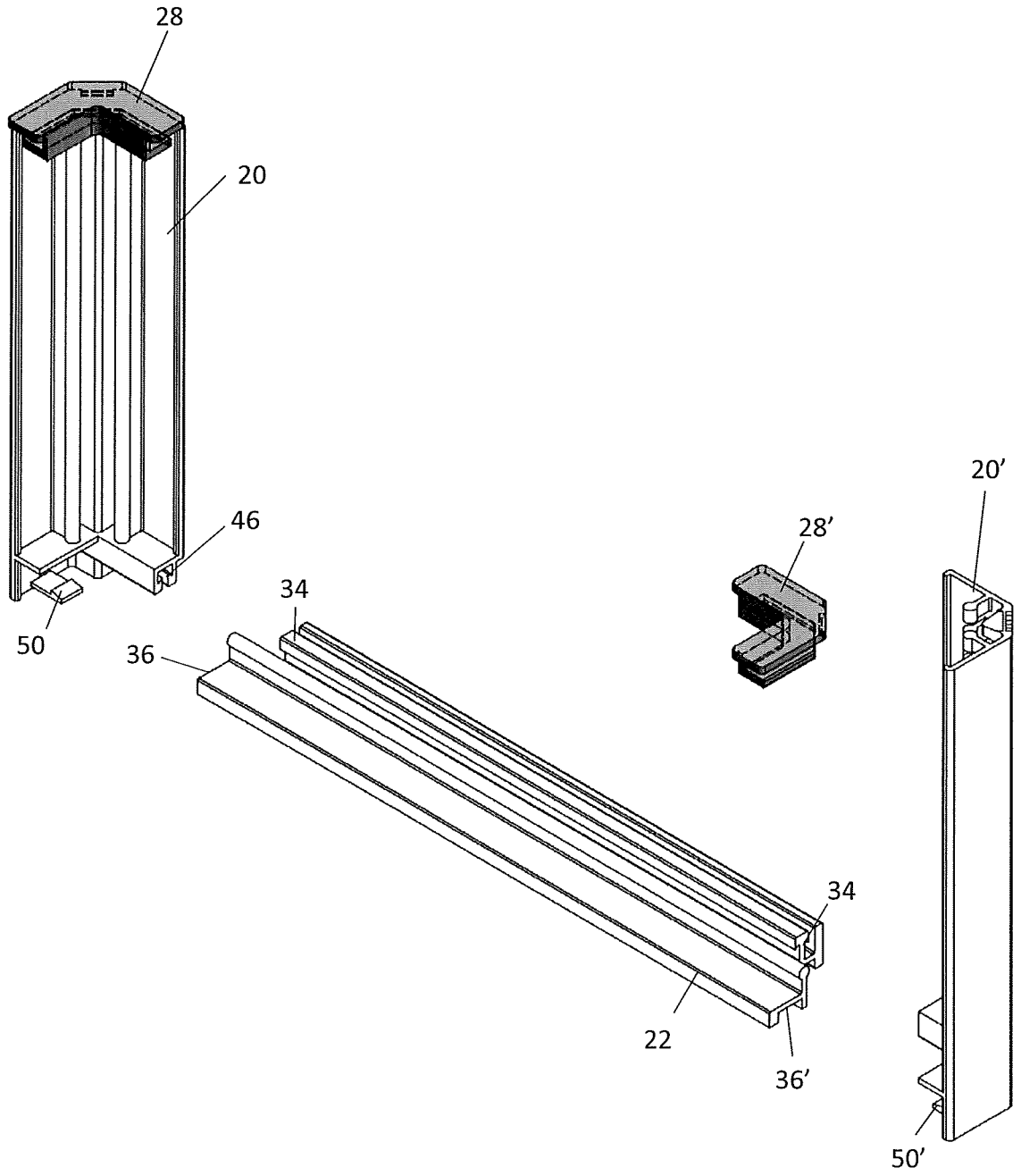
FIG. 10 is an exploded view of two corner rail assemblies and a bottom rail assembly.

FIG. 10 shows how a bottom rail assembly 22 may be connected to a pair of corner rail assemblies 20 and 20'. Those connections are usually made after the slat assemblies 12 (not shown in FIG. 10) that faun the bottom face 26 are connected to the bottom rail assemblies. One end of the bottom rail assembly 22 is connected to the corner rail assembly 20 as the second rail 34 is slid into slot 46. As the second rail 34 slides into slot 46, the hook 50 slides over recess 36 and is secured by ridge 38 (not seen in FIG. 10). The other end of the bottom rail assembly 22 is connected to a corner rail assembly 20' as the other end of second rail 34 is inserted into a slot on the corner rail assembly 20' and the corner rail assembly 20' is secured by inserting its hook 50' through recess 36' onto a ridge 38 on the other end of the bottom rail assembly 22. Since the pair of corner rail assemblies 20 and 20' cap the ends of bottom rail assembly 22, the plurality of slat assemblies 12 that form the bottom face 26 of the crate assembly 10 are secured from sliding off the horizontal rail 30.

Figure 11:
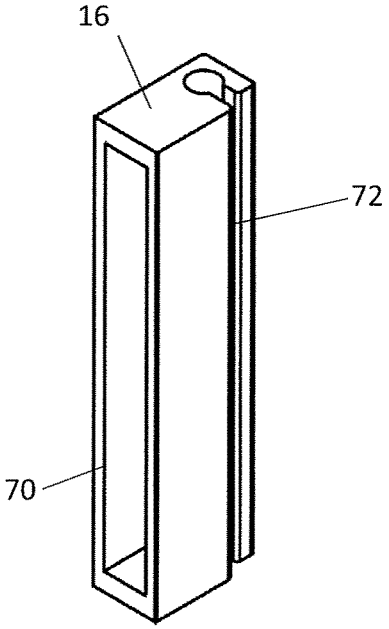
FIG. 11 is an overhead perspective view of a cap according to one embodiment.
Figure 12:
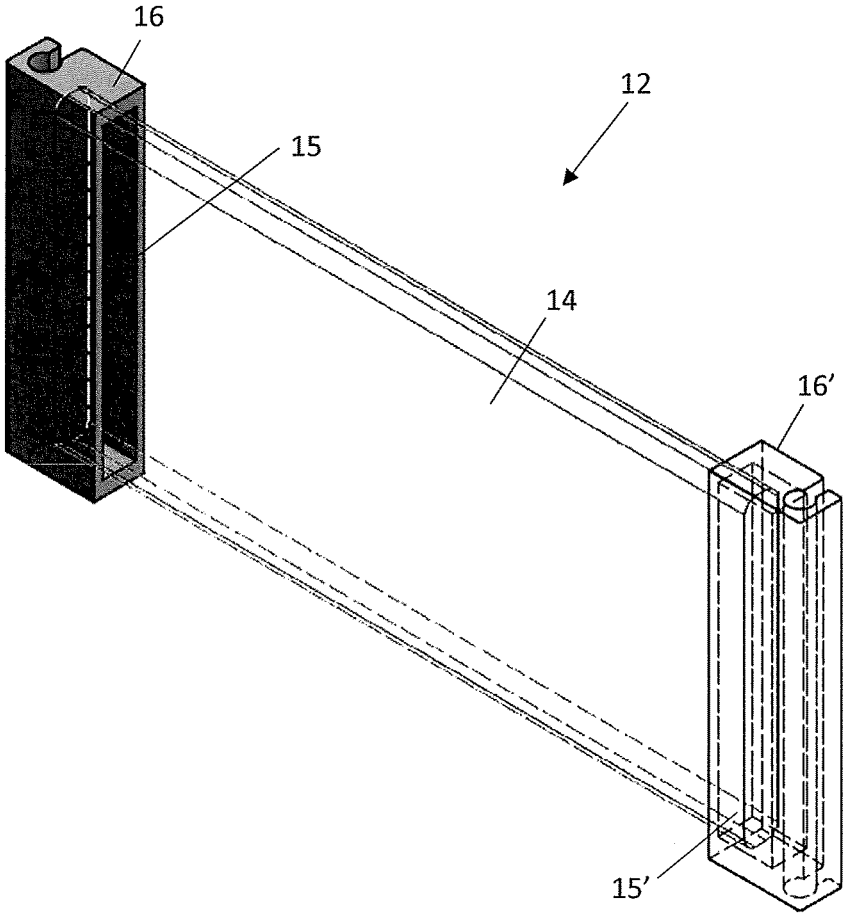
FIG. 12 is an overhead perspective view of a slat assembly according to one embodiment.
Figure 13:
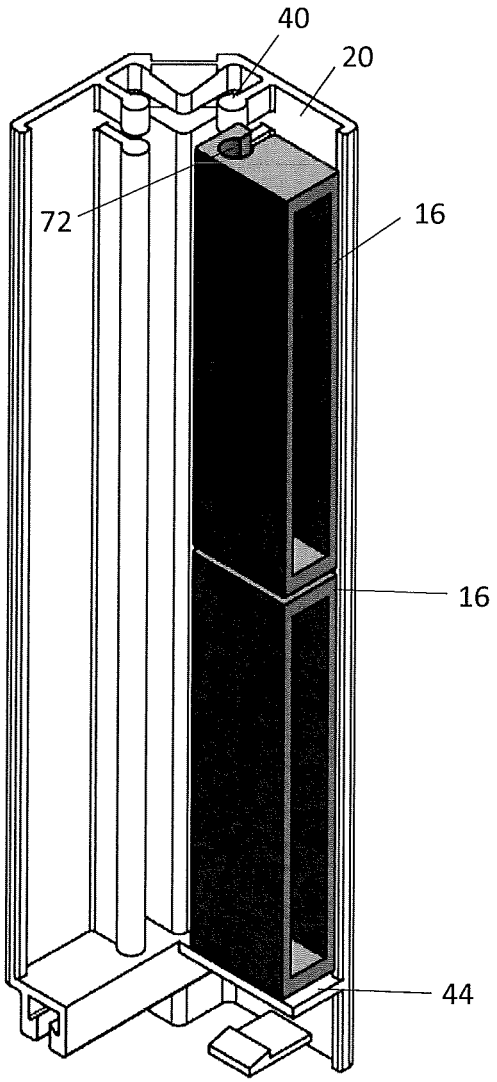
FIG. 13 is an inside perspective view of a corner rail assembly with two caps installed on the vertical rail.
Figure 14:
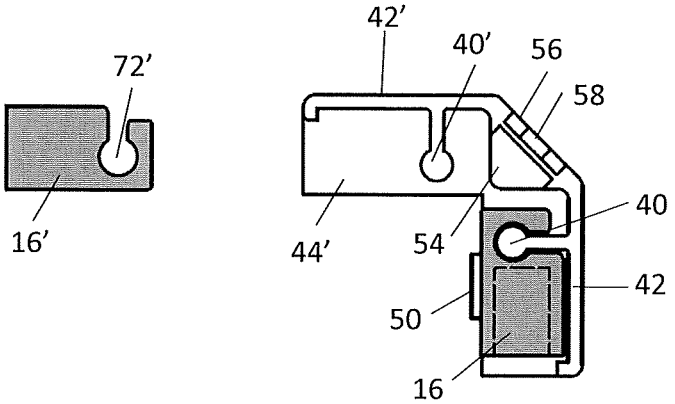
FIG. 14 is a top exploded view of the corner rail assembly with caps installed on the vertical rail.

One example of a cap 16 for forming a slat assembly 12 is shown in FIG. 11. The cap 16 includes a recess 70 for receiving an end of a slat 14 (as seen in FIG. 12), and a channel 72 adapted for sliding along a rail 30 or 40. The recess is preferably sized to receive and grip the end of the slat. If desired, glue can be added to aid in retention, or a hole can be provided in the side of cap 16, so a screw or the like can be used to hold the slat in place. The channel 72 is preferably substantially round to prevent the cap from unintentionally detaching off the rail in a direction perpendicular to the channel 72. FIG. 12 shows a slat having a cap 16 at one end and a cap 16' at another end to form a slat assembly 12. FIGS. 13 and 14 illustrate how a plurality of caps 16 (absent their slats) connect with a corner rail assembly 20. Channel 72 slides along vertical rail 40, with the floor 44 preventing a plurality of slat assemblies from sliding off a bottom end of the corner rail assembly 20.

The crate assembly may be sold as a kit of components, including a plurality of slats 14 with caps 16 to form slat assemblies 12, a plurality of corner rail assemblies 20, a plurality of bottom rail assemblies 22, and a plurality of top caps 28.

The invention may also be considered a method for assembling a crate. For example, the method includes placing a cap having a channel on each end of ones of a plurality of slats to make a plurality of slat assemblies. One or more slat assemblies are slid along the horizontal rails of the first and second bottom rail assemblies to form a bottom face of the crate. A first bottom rail assembly having a horizontal rail is connected to a pair of corner rail assemblies, with each corner rail assembly having a vertical rail. A second bottom rail assembly having a horizontal rail is connected to another pair of corner rail assemblies having vertical rails. One or more slat assemblies are slid along the vertical rails for each pair of corner rail assemblies to form the side faces of the crate. A top cap may also be connected onto a top end of each corner rail assembly to secure the slat assemblies onto the vertical rails.

Certain modifications and improvements will occur to those skilled in the art upon reading the foregoing description. By way of example, the corner rail assemblies may be comprised of more than two walls having an angle other than 90 degrees to form other types of polygonal shapes. It should be understood that all such modifications and improvements have been omitted for the sake of conciseness and readability, but are properly within the scope of the following claims.

What is claimed is:

1. A method for assembling a crate comprising:

placing a cap having a channel on each end of ones of a plurality of slats to make a plurality of slat assemblies;

sliding one or more slat assemblies along the horizontal rails of first and second bottom rail assemblies having a horizontal rail to form a bottom face;

connecting the first bottom rail assembly to a pair of corner rail assemblies, each corner rail assembly having a vertical rail;

connecting the second bottom rail assembly to another pair of corner rail assemblies that each have a vertical rail; and sliding one or more slat assemblies along the vertical rails for each pair of corner rail assemblies to form a set of side faces.

2. The method of claim 1 further including connecting a top cap onto a top end of each corner rail assembly to secure the slat assemblies onto the vertical rails.

3. A kit for assembling a crate comprising:

a plurality of slats;

a plurality of caps each adapted to be fitted onto an end of a slat to make a slat assembly, each cap having a channel adapted to slide the slat assembly along a rail;

a plurality of corner rail assemblies each defining a corner of the crate, each corner rail assembly including a vertical rail adapted for receiving the cap of a slat assembly; and a plurality of bottom rail assemblies, each bottom rail assembly having one end connected to a bottom end of one corner rail assembly and an opposing end connected to a bottom end of another corner rail assembly, each bottom rail assembly including a horizontal rail adapted for receiving the cap of a slat assembly;

wherein a bottom face of a crate is formed by installing slat assemblies onto the bottom rail assemblies and a side face of the crate is formed by installing slat assemblies onto a pair of corner rail assemblies.

4. The kit of claim 3 further including a plurality of top caps adapted to be mounted onto a top end of each corner rail assembly to secure the slats onto the vertical rails.

5. A crate assembly comprising:

a plurality of slats with each slat having a cap on each end making a slat assembly, the cap having a channel adapted to slide the slat along a rail;

a plurality of corner rail assemblies each defining a corner of the crate assembly, each corner rail assembly including a vertical rail adapted for receiving the cap of a slat assembly; and a plurality of bottom rail assemblies, each bottom rail assembly having one end connected to a bottom end of one corner rail assembly and an opposing end connected to a bottom end of another corner rail assembly, each bottom rail assembly including a horizontal rail adapted for receiving the cap of a slat assembly;

wherein the crate assembly has a bottom face and a plurality of side faces, the bottom face comprising slat assemblies installed onto the bottom rail assemblies and each side face comprising slat assemblies installed onto a pair of corner rail assemblies.

6. The crate assembly of claim 5, wherein two bottom rail assemblies are attached to four corner rail assemblies to form a substantially cuboidal shape.

7. The crate assembly of claim 5, wherein each bottom rail assembly includes a second rail and each corner rail assembly includes a slot for receiving the second rail of the bottom rail assembly.

8. The crate assembly of claim 7, wherein the second rail and the slot are substantially T-shaped.

9. The crate assembly of claim 8, wherein the slot and the second rail comprise a T-shape having about a 45 degree angle crevice on each side of the T-shape to prevent the slot from splaying and releasing the second rail when a load is applied.

10. The crate assembly of claim 7 further including a lock on each corner rail assembly to secure the bottom rail assembly onto the corner rail assembly.

11. The crate assembly of claim 10, wherein the lock is comprised of a hook on the corner rail assembly, a recess adapted to receive the hook on the bottom rail assembly, and a ridge on the bottom rail assembly adapted to retain the hook within the recess.

12. The crate assembly of claim 5 further including a top cap installed on each corner rail assembly to secure the slats.

13. The crate assembly of claim 12, wherein the top cap is secured by inserting a hook on the top cap over a ridge onto a recess on a top end of the corner rail assembly whereby the ridge retains the hook within the recess.

14. The crate assembly of claim 5, wherein each corner rail assembly is comprised of two walls with a vertical rail on each wall.

15. The crate assembly of claim 5, wherein the channel and the rail each have one of a substantially round male/female complement to prevent the slat from detaching from the rail.

16. The crate assembly of claim 15, wherein the female complement is on the channel and the male complement is on the rail.

17. The crate assembly of claim 5, wherein the slats are comprised of wood.

18. A crate assembly comprising:

a plurality of slats with each slat having a cap on each end making a slat assembly, the cap having a channel adapted to slide the slat along a rail;

a set of four corner rail assemblies each defining a corner of the crate assembly, each corner rail assembly including a vertical rail adapted for receiving the cap of a slat assembly and a substantially T-shaped slot;

a set of two bottom rail assemblies, each bottom rail assembly including a horizontal rail adapted for receiving the cap of a slat assembly and a substantially T-shaped rail for insertion into the substantially T-shaped slot of the corner rail assembly whereby each bottom rail assembly has one end connected to a bottom end of one corner rail assembly and an opposing end connected to a bottom end of another corner rail assembly;

a set of locks for securing each bottom rail assembly to a corner rail assembly, each lock comprising a hook on the corner rail assembly, a recess adapted to receive the hook on the bottom rail assembly, and a ridge on the bottom rail assembly adapted to retain the hook within the recess, wherein the crate assembly has a bottom face and a plurality of side faces, the bottom face comprising slat assemblies installed onto the bottom rail assemblies and each side face comprising slat assemblies installed onto a pair of corner rail assemblies.

* * * * *